United States Patent [19]

Fanselow

[11] 4,245,032

[45] Jan. 13, 1981

[54] PHOTOCHROMIC AZIRIDINE RECORDING MEDIA

[75] Inventor: Dan L. Fanselow, White Bear Lake, Minn.

[73] Assignee: Minnesota Mining and Manufacturing Company, St. Paul, Minn.

[21] Appl. No.: 973,930

[22] Filed: Dec. 28, 1978

Related U.S. Application Data

[63] Continuation of Ser. No. 811,254, Jun. 29, 1977, abandoned.

[51] Int. Cl.[3] ..... G03C 1/52

[52] U.S. Cl. ..... 430/338; 430/961; 430/962

[58] Field of Search ..... 96/67, 90 PC, 90 R, 96/50 PL; 252/300; 430/962, 961, 338, 343, 513, 523

[56] References Cited

U.S. PATENT DOCUMENTS

| | | | |
|---|---|---|---|
| B 283,124 | 1/1975 | Berkes et al. | 96/90 PC |
| 3,042,515 | 7/1962 | Wainer | 96/90 R |
| 3,320,067 | 5/1967 | Taylor | 96/90 PC |
| 3,442,649 | 5/1969 | Rasch et al. | 96/50 PL |
| 3,609,165 | 9/1971 | Heine | 96/90 PC |
| 3,785,820 | 1/1974 | Inoue et al. | 96/90 PC |
| 3,795,529 | 3/1974 | Cartmell et al. | 96/90 PC |
| 3,894,874 | 7/1975 | Schleigh | 96/90 PC |
| 3,984,177 | 10/1976 | Trozzolo | 252/300 |
| 4,018,604 | 4/1977 | Bachman | 96/67 |

*Primary Examiner*—Won H. Louie, Jr.

*Attorney, Agent, or Firm*—Cruzan Alexander; Donald M. Sell; Gerald F. Chernivec

[57] ABSTRACT

Photochromic aziridines of the formula

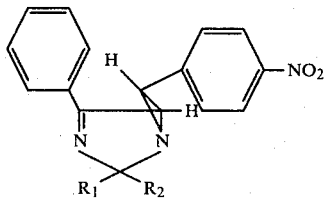

wherein $R_1$ and $R_2$ separately are hydrogen, lower alkyl, phenyl, or ortho or para lower alkyl or lower alkoxy substituted phenyl, and together are alkylene having 4 to 7 carbon atoms inclusive, are coated onto a substrate to provide a microcrystalline deposit thereon preferably followed by application of a barrier coating which is substantially oxygen-impermeable. In this manner, a thermally stable optically erasable imaging medium is provided.

9 Claims, No Drawings

PHOTOCHROMIC AZIRIDINE RECORDING MEDIA

This is a continuation of application Ser. No. 811,254 filed June 29, 1977, now abandoned.

BACKGROUND OF THE INVENTION

This invention relates to media which can be imaged by exposure to actinic radiation. More particularly, the invention relates to articles capable of being used for imaging based on photochromic aziridines, which allow the image-forming operation to be reversible, i.e., the recorded image may be erased.

Many conventional imaging materials undergo irreversible changes when exposed to actinic radiation. Thus, erasure is impossible without physical destruction of the image itself. Additionally, in many instances, the image formed is latent, and subsequent development is necessary.

Photochromes are compounds which change color reversibly on exposure to actinic radiation. Such direct-developing photochromic materials, however, traditionally suffer the limitation that images produced from systems containing these materials have very little stability, i.e., the image will fade spontaneously within a few minutes or hours at room temperature.

It has now been ascertained that particularly defined photochromic aziridine compounds can be utilized for imaging wherein the recorded image may be erased and information may be added, the film may be re-used, etc.

In Schleigh et al, U.S. Pat. No. 3,894,874, there is described the use of aziridines in photoreductive imaging. A reducible, image-forming compound is combined with the photochromic aziridine in a binder on a substrate to form a radiation-sensitive layer. Upon exposure to actinic radiation, followed by heating, an image may be obtained. Furthermore, partly crystalline and partly crystallographically aligned photochromic aziridines and oxiranes are disclosed as having utility in windshields, sunglasses, and light switching devices in U.S. Pat. No. 3,964,823.

It has now been found that by applying hereinafter-defined photochromic microcrystalline aziridines onto a substrate, and by utilizing an oxygen barrier material to cover the microcrystalline aziridine coating, or by incorporating same in the coating application solution, the lifetime of the image formed by exposure to actinic radiation can be increased at least a thousand times more than that of the photochromic aziridine in oxygen or air.

SUMMARY OF THE INVENTION

In accordance with the invention, there is provided a thermally stable optically erasable imaging medium comprising a substrate having on at least one surface thereof a microcrystalline coating of at least one photochromic aziridine of the formula

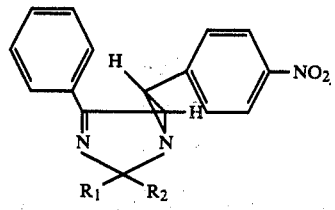

wherein $R_1$ and $R_2$ separately are hydrogen, lower alkyl, phenyl, or ortho or para lower alkyl or lower alkoxy substituted phenyl, and together are alkylene having 4 to 7 carbon atoms inclusive, and overlying said coating, or integral therewith, a substantially oxygen-impermeable barrier which is reasonably transparent to actinic radiation.

The medium can be imaged by exposure to actinic radiation, optically erased, and reimaged, with the image being substantially resistant to thermal bleaching.

DETAILED DESCRIPTION OF THE INVENTION

The photochromic aziridines utilized in this invention are $2R_1,2R_2$-6(p-nitrophenyl)-4-phenyl-1,3-diazabicyclo[3.1.0]hex-3-enes, which can be structurally designated:

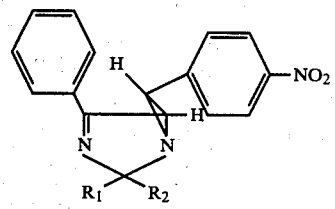

wherein $R_1$ and $R_2$ taken separately are hydrogen, lower alkyl, phenyl, or ortho or para lower alkyl or lower alkoxy subsituted phenyl (wherein the term "lower" designates from 1 to 4 carbon atoms), and wherein $R_1$ and $R_2$ taken together are alkylene having 4 to 7 carbon atoms inclusive. These compounds can be synthesized by the method disclosed by Heine et al in J. Org. Chem. 32, 2708–10 (1967) and in U.S. Pat. No. 3,609,165. The most preferred compound for this invention is the dimethyl derivative, 2,2′-dimethyl-6(p-nitrophenyl)-4-phenyl-1,3-diazabicyclo[3.1.0]hex-3-ene. Preferred alkylene derivatives include the cyclohexyl and cyclopentyl derivatives.

These aziridines are colorless prior to exposure to an electron beam or ultraviolet radiation, but upon exposure, the compounds turn various shades of blue depending upon the $R_1$ and $R_2$ groups contained herein. If such compounds are placed in the dark, they again become colorless; hence the color change is reversible. Additionally, they may be bleached thermally or by exposure to visible radiation, i.e., they will revert to their colorless condition by use of such methods. Therefore it is known that the colorless form of the photochromic aziridine can be converted to the colored form upon exposure to electron beam or ultraviolet radiation, and the reversible reaction back to the colorless form can occur upon exposure of the aziridine to visible light, or when placed in the dark, or thermally.

This can be depicted by the following:

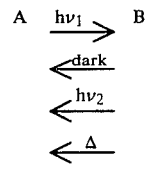

wherein A represents the colorless form, B the colored form, $\nu_1$ is a radiation frequency limited to the ultraviolet, and $\nu_2$ is a radiation frequency limited to the visible.

It has now been ascertained that in the absence of oxygen, the thermal bleaching reaction can be substantially diminished, and the photochromic material can be rendered dark-stable, i.e.

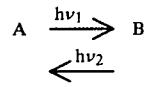

To illustrate this phenomenon, strips of filter paper were saturated with benzene solutions of various aziridines of the above formula and dried. The strips were then irradiated with ultraviolet to generate the blue form. One set of these irradiated strips was kept in a nitrogen atmosphere in the dark, and another set was kept in an oxygen atmosphere. Both sets were maintained at room temperature in the dark. The time required to bleach to one-half of the original optical density was estimated visually and is recorded in Table 1. Considerable care was taken to minimize exposure of the samples to light during the periodic readout.

TABLE 1

| Aziridine Derivative | Time Required to Bleach to One-half Optical Density | |
|---|---|---|
| | $O_2$ Atmosphere | $N_2$ Atmosphere |
| $R_1 = R_2 = CH_3$ | 40 minutes | >1 year |
| $(R_1 + R_2)$ = cyclopentyl | 3 hours | >3 months |
| $(R_1 + R_2)$ = cyclohexyl | 10 hours | ~2 months |
| $R_1 = CH_3$, $R_2 = C_6H_5$ | 10 minutes | ~3 months |
| $R_1 = H$, $R_2 = C_3H_7$ | 10 hours | 1 month |
| $R_1 = R_2 = C_2H_5$ | 20 minutes | 3 days |
| $R_1 = CH_3$, $R_2 = CH(CH_3)_2$ | 10 minutes | 3 weeks |
| $R_1 = H$, $R_2 = C_6H_5$ | <10 minutes | 2 days |
| $R_1 = H$, $R_2$ = o-methoxyphenyl | <10 minutes | 15 hours |

It has been found that by utilizing, in conjunction with aziridines, film-forming materials which are substantially impermeable to oxygen, the image stability, i.e., resistance to thermal bleaching, can be effectively maintained. Exemplary and preferred film-forming materials which are substantially impermeable to oxygen include polyvinyl alcohol and gelatin. The oxygen barrier should of course also be reasonably transparent to actinic radiation.

In preparing the recording medium, the aziridines can be simply dissolved in an organic solvent, e.g., benzene, at a concentration sufficient to provide a uniform microcrystalline coating, applied to the substrate surface, and dried. In this instance it is preferred to use saturated solutions to maximize coloration and porous substrates, e.g., paper. Following this, the film-forming oxygen barrier material can be coated over the microcrystalline aziridine layer in a single coating operation or, preferably as multiple coatings to maximize image stability.

Alternatively, the aziridines can be coated from dispersions with a film-forming binder material, such as cellulose nitrate, polyacrylonitrile, polyvinyl alcohol, etc. It is imperative that the aziridines be in microcrystalline form on the substrate to function in the invention, and therefore binder compounds in which the aziridines are soluble should be avoided. Concentration of the particulate aziridines in the dispersion should be sufficient to provide a uniform microcrystalline aziridine coating on the substrate.

In this latter case, it is preferred to utilize film-forming binder compounds which in themselves are substantially impermeable to oxygen, e.g., polyvinyl alcohol as a separate oxygen barrier overcoat may become unnecessary. To maximize image stability, however, again it is preferred to utilize one or more subsequent barrier coatings of a substantially oxygen-impermeable material.

The foregoing system does not affect the extraordinarily high ultraviolet and electron beam coloration sensitivity associated with the aziridines, nor does it eliminate the optical bleaching thereof. Dyes can be added to the barrier coat to select wavelengths that cause coloration of the aziridine. For example, Alizarine Yellow dye can be added to the oxygen barrier coating to minimize background coloration from incandescent room lighting, but still allow imaging with, for example, the 312.5 nm line from a mercury lamp.

Since moisture will adversely affect the oxygen-barrier properties of, for example, polyvinyl alcohol, it may be desirable, for example in high humidity conditions, to incorporate a radiation transparent moisture barrier either in intimate contact with the article or surrounding it, e.g., a film of a copolymer of vinylidene chloride and vinyl chloride.

The receptor substrates utilized in the present invention may be flexible or rigid, porous or non-porous, and may be reflective, opaque, or transparent. Images can be produced on aziridine-coated substrates such as glass, quartz, polycarbodiimide-primed polyester film, tin oxide-coated quartz and glass, polyester which has been vapor coated with aluminum, paper, etc.

The invention will now be more specifically described with the aid of the following non-limiting examples, wherein all parts are by weight unless otherwise specified. In all cases, preparation of the photochromic coating was carried out in a laboratory equipped with yellow safe lights to eliminate extraneous ultraviolet radiation.

EXAMPLE 1

Strips of filter paper were dipped in a saturated benzene solution of 2,2'-dimethyl-6(p-nitrophenyl)-4-phenyl-1,3-diazabicyclo[3.1.0]hex-3-ene and dried. The resulting strips were subsequently dip-coated in a 4 percent by weight aqueous polyvinyl alcohol solution and dried with a heat gun. One strip was dipped in the polyvinyl alcohol and dried once, another three times and another five times. These strips and an uncoated strip were then exposed to ultraviolet radiation from a Sylvania F4T5/BLB black light to bring them to a reflective optical density of about 0.90 and then stored in air in the dark in a 50° C. oven. A second set was stored in air in the dark in a 0° C. refrigerator. At various intervals the samples were removed and reflective optical density measurements were made. These measurements are illustrated in Tables 2 and 3 below.

Table 2

| No. of Coatings Polyvinyl Alcohol | Dark Storage in Air at 50° C. Reflective Optical Density 0 min. | 200 min. | 400 min. | 600 min. | 800 min. | 1000 min. |
|---|---|---|---|---|---|---|
| 0 | 0.9 | 0.1 | — | — | — | — |
| 1 | 0.9 | 0.47 | 0.4 | 0.38 | 0.3 | 0.25 |
| 3 | 0.9 | 0.73 | 0.68 | 0.65 | 0.63 | 0.62 |
| 5 | 0.9 | 0.78 | 0.75 | 0.74 | 0.73 | 0.73 |

Table 3

| No. of Coatings Polyvinyl Alcohol | Dark Storage in Air at 0° C. Reflective Optical Density 0 min. | 200 min. | 400 min. | 600 min. | 800 min. | 1000 min. |
|---|---|---|---|---|---|---|
| 0 | 0.9 | 0.63 | 0.55 | 0.48 | 0.44 | 0.36 |
| 1 | 0.9 | 0.8 | 0.77 | 0.74 | 0.72 | 0.69 |
| 3 | 0.9 | 0.86 | 0.85 | 0.84 | 0.83 | 0.82 |
| 5 | 0.9 | 0.88 | 0.87 | 0.86 | 0.85 | 0.84 |

At the end of this experiment the samples were bleached optically by a one-half hour exposure to a 100 watt yellow General Electric "Bug Lite" at a distance of six inches. The samples were reimaged and there was no apparent loss in sensitivity, nor were ghost patterns present.

EXAMPLE 2

A 1.0 gram sample of 2,2'-dimethyl-6(p-nitrophenyl)-4-phenyl-1,3-diazabicyclo[3.1.0]hex-3-ene was ground to a fine particle size in a mortar and pestle. Ten grams of a 4 percent by weight aqueous polyvinyl alcohol solution were added to the aziridine and the mixture was then ground for a few minutes to achieve a uniform dispersion. The dispersion was applied by brush to white cardboard and dried with a heat gun. The entire substrate was then dipped in a 4 percent by weight aqueous polyvinyl alcohol solution and dried with a heat gun. Dipping and drying was repeated three more times to insure a complete seal of the aziridine from air.

This medium was then contact-printed from a negative by exposing it for five seconds to the mercury lamp in a "Colite" exposure unit. A clear, sharp blue image on white background was produced. The image was bleached out by exposing the sample for one-half hour to a yellow incandescent General Electric "Bug Lite" at a distance of six inches. When it was reimaged, there were no ghost images or apparent loss of sensitivity. This imaged sample was stored in the dark with no image deterioration over a period of one week.

A second portion of this sample was dip-coated and dried twice from a solution of 0.15 gram Alizarine Yellow dye in 25 milliliters of a 4 percent by weight aqueous polyvinyl alcohol solution. This sample was exposed for 60 seconds to the "Colite" unit through a negative. A sharp, green image on yellow background was obtained. The background in this image came up only slightly after 30 minutes exposure to overhead "Cool White" fluorescent lights.

What is claimed is:

1. A thermally stable, optically erasable recording medium comprising a substrate having on at least one surface thereof a first coating of at least one microcrystalline photochromic aziridine of the formula

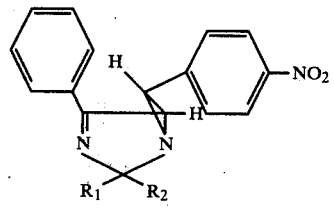

wherein $R_1$ and $R_2$ separately are hydrogen, phenyl, lower alkyl, or ortho or para lower alkyl or lower alkoxy-substituted phenyl or together are alkylene having 4 to 7 carbon atoms; and overlying said first coating, at least one substantially oxygen-impermeable barrier coating, said barrier coating being reasonably transparent to actinic radiation.

2. The recording medium of claim 1 wherein $R_1$ and $R_2$ are methyl groups.

3. The recording medium of claim 1 wherein said barrier coating comprises polyvinyl alcohol.

4. The recording medium of claim 1 wherein said barrier coating comprises gelatin.

5. The recording medium of claim 1 wherein said alkylene is selected from the group consisting of cyclohexyl and cyclopentyl.

6. The recording medium of claim 1 wherein said substrate is porous.

7. The recording medium of claim 6 wherein said substrate is paper.

8. The recording medium of claim 1 wherein said first coating additionally contains a film-forming binder.

9. The recording medium of claim 8 wherein said binder is polyvinyl alcohol.

* * * * *